United States Patent [19]

Cho

[11] Patent Number: 4,616,665

[45] Date of Patent: Oct. 14, 1986

[54] LIGHTING DEVICE FOR CIGARETTES

[76] Inventor: Saeng K. Cho, 1428 Whitburn Ave., Fayetteville, N.C. 28304

[21] Appl. No.: 514,781

[22] Filed: Jul. 18, 1983

[51] Int. Cl.[4] ..... A24D 1/00; A24D 47/00

[52] U.S. Cl. ..... 131/351; 131/329; 131/366

[58] Field of Search ..... 131/351, 329, 366

[56] References Cited

U.S. PATENT DOCUMENTS 1,669,843 5/1928 Sakamoto ..... 131/366
2,652,060 9/1953 Shio ..... 131/366
3,273,568 9/1966 Di Carlo ..... 131/351
3,994,305 11/1976 Hughes ..... 131/351

*Primary Examiner*—V. Millin
*Attorney, Agent, or Firm*—Birch, Stewart, Kolasch & Birch

[57] ABSTRACT

A lighting device for cigarettes or similar tobacco products comprised of a substantially cylindrical paper support for slidably engaging the filter portion of a cigarette, and including an adhesively attached match and a match striking means associated therewith which is covered by a removable tear portion defined by perforations in the cylindrical support.

11 Claims, 6 Drawing Figures

LIGHTING DEVICE FOR CIGARETTES

BACKGROUND AND FIELD OF THE INVENTION

The present invention relates to a lighting device for cigarettes or similar tobacco products for providing a cigarette with a ready to use lighting means associated with an individual cigarette, and including an attached match and match striking means associated therewith for lighting the match.

Some previous devices have been constructed for attaching lighting equipment to cigarettes or cigars as exemplified by U.S. Pat. No. 527,724 to Sarapata et al, U.S. Pat. No. 743,208 to Weiller, U.S. Pat. No. 1,221,634 to Van Deventer, U.S. Pat. No. 1,837,771 to Haakh, U.S. Pat. No. 2,278,642 to Boucher and U.S. Pat. No. 2,653,613 to Dussich. However, none of these provide lighting equipment in a device which is both aesthetically pleasing and simple to construct and use.

OBJECTS AND SUMMARY OF THE INVENTION

It is therefore one object of the present invention to provide a lighting device for attaching lighting equipment to cigarettes or the like tobacco products, wherein the lighting device includes a match and a match striking means associated therewith.

It is another object of the present invention to provide a lighting device for cigarettes which includes a substantially cylindrical support means which is of a size substantially equal to that of a filter portion of a cigarette to provide an aesthetically desirable design for the lighting device.

It is a further object of the present invention to provide a lighting device including a match striking means which, for appearance purposes, is covered when not in use, but which can be easily uncovered for lighting a match.

These and further objects of the present invention are accomplished by providing a lighting device for cigarettes or similar tobacco products comprised of a substantially cylindrical support means which slidably engages the filter portion of a cigarette, and which includes a match and a match striking means for lighting the match.

BRIEF DESCRIPTION OF THE INVENTION

Figure 1:
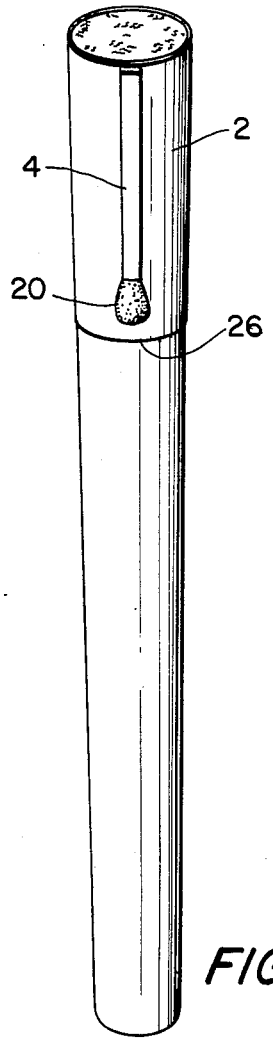
FIG. 1 is a perspective view of the device according to the present invention.
Figure 2:
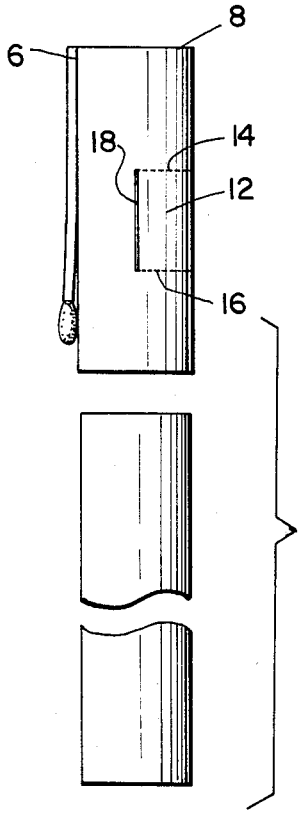
FIG. 2 is a side view of the device according to the present invention.

The lighting device of the present invention as shown in FIGS. 1 and 2 is generally comprised of a cylindrical support portion 2, typically made of paper, having a match 4 adhesively attached thereto in a direction substantially parallel to the length of the cigarette. The cylindrical support portion 2 slidably engages the cigarette at the end which includes a filter portion and is of a size substantially equal to that of the filter portion, providing a good design appearance to a cigarette having the lighting device of the present invention placed thereon. The match 4 is attached to the cylindrical support portion 2 at an area 6 at the end of the match which includes an adhesive. Match 4 is attached substantially adjacent to the top end 8 of the cylindrical support portion.

The cylindrical support portion 2 also includes a match striking means 10 provided for striking the match 4 for lighting the cigarette. The match striking means 10 may be made of any known material typically used in match packages for providing a match striker. When engaged with a cigarette, the match striking portion 10 is covered by a tear portion 12 defined by perforations 14 and 16, and an edge 18 which is made from an area cut directly through the cylindrical support portion 2 and which provides a grasping edge. The tear portion 12 serves as a cover for the match striking means 10 when not in use, giving the device a good appearance.

Figure 3:
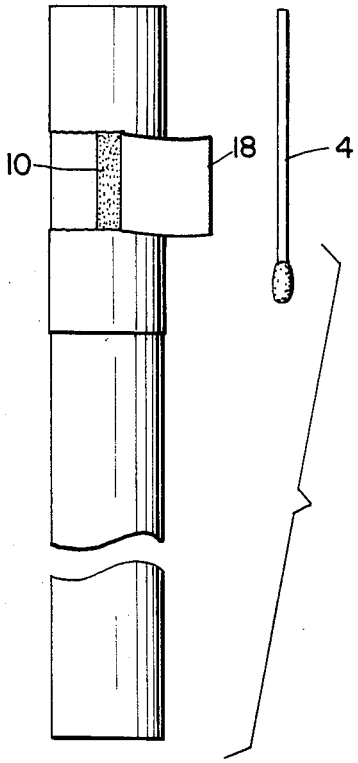
FIG. 3 is a side view of the device according to the present invention showing the movable cover means moved to a position for exposing the match striking means and having the match attached therefrom.
Figure 5:
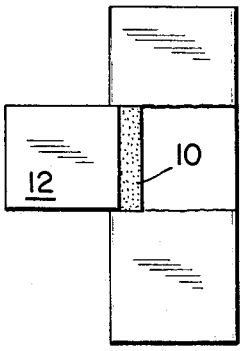
FIG. 5 is a front view of the present invention showing a cylindrical support portion pressed flat.

As best shown in FIG. 3, when it is desired to strike a match against the striking portion 10, the user grasps the edge 18 and pulls the tear portion 12 back along the perforations 14,16, thereby exposing the match striking portion 10. After removing the match 4, the cylindrical support portion 2 is pressed flat as shown in FIG. 5, and the head 20 of the match is struck against the match striking portion 10 in order to light the match for lighting the cigarette.

Figure 4:
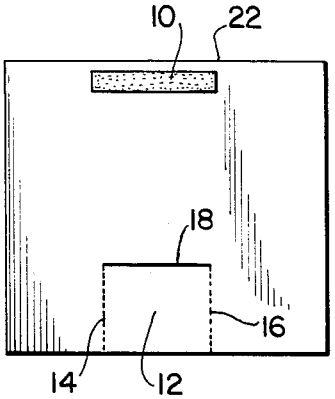
FIG. 4 is a top plan view of the cylindrical support means in its unrolled form prior to being manufactured in a shape for engagement with a cigarette.

The cylindrical support portion 2, as best shown in FIG. 4, is manufactured from a substantially rectangular piece of paper on which is formed the tear portion 12 by scoring perforations 14,16 and cutting through the paper at the middle thereof in order to form the edge 18. On the other side of the rectangular piece of paper, a piece of match striking material is adhesively attached for forming the match striking portion 10. This portion is applied to the rectangular piece of paper substantially adjacent to the edge 22 and opposite the tear portion 12. The match striking portion 10 is applied substantially adjacent to edge 22 so that when in its flattened form as shown in FIG. 5, striking of the match head 20 against the striking portion 10 will not result in accidentally igniting any portion of the paper which comprises the cylindrical support portion 2.

Figure 6:
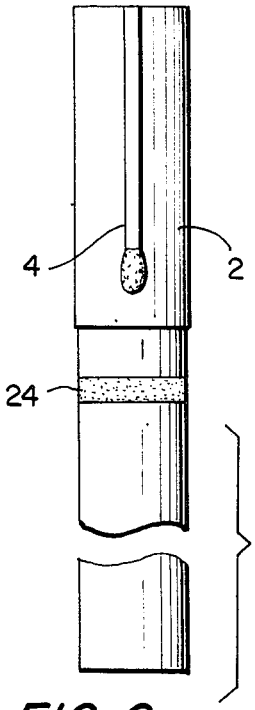
FIG. 6 is a perspective view of another embodiment of the present invention.

In another embodiment of the invention as shown in FIG. 6, instead of providing a match striking portion 10 on the cylindrical support portion 2, a match striking portion 24 is provided by a ring of match striking material encircling the cigarette on the filter portion of the cigarette. In this embodiment, the match 4 is detached from the support portion 2 and then struck against the match striking portion 24 for lighting the match and cigarette.

In both embodiments of the invention, the cylindrical support portion can be provided with a variety of different designs for giving the desired aesthetic appearance. Most preferably, the outer face of the match 4 is provided with a design, such as stars and stripes, and the bottom edge 26 of the cylindrical support portion 2 is provided with a ring of designs, either stars or stripes, corresponding to the design on the outer face of the match 4.

In addition to providing a device for lighting cigarettes, the positioning of the match 4 in a direction parallel to the length of the cigarette can also provide a means for clipping the cigarette to a shirt pocket or the like by placing the cigarette in the pocket and clipping the shirt pocket between the match 4 and the cylindrical support portion 2.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

I claim:

1. A lighting device for cigarettes or the like tobacco products comprising:

substantially cylindrical support means for slidably engaging a tobacco product;

a match means associated with said support means;

a match striking means associated with said support means for lighting a match; and a movable cover means for covering said match striking means when not in use and being movable to a position for exposing said match striking means said movable cover means comprising a perforated portion in said cylindrical support means.

2. A lighting device as in claim 1, wherein said cylindrical support means is of a size substantially equal to that of a filter portion of a cigarette.

3. A lighting device as in claim 1, wherein said match means is adhesively attached to said cylindrical support means.

4. A lighting device as in claim 1, wherein said cylindrical support means is made of paper.

5. A lighting device for cigarettes or the like tobacco products comprising:

substantially cylindrical support means for slidably engaging a tobacco product;

a match means associated with said support means;

a match striking means associated with said support means for lighting a match; and a perforated portion in said cylindrical support means for defining a cover means for covering said match striking means when not in use and being movable by tearing along perforations for exposing said match striking means.

6. A lighting device as in claim 5, wherein said cylindrical support means is of a size substantially equal to that of a filter portion of a cigarette.

7. A lighting device as in claim 5, wherein said match means is adhesively attached to said cylindrical support means in a direction substantially parallel to the length of a cigarette.

8. A lighting device as in claim 5, wherein said cylindrical support means is made of paper.

9. A lighting device and a cigarette in combination, comprising:

a cigarette including a filter portion at one end thereof;

a substantially cylindrical support means for slidably engaging said cigarette and being of a size substantially equal to that of said filter portion;

a match means associated with said support means; and a match striking means for lighting a match, said match striking means being associated with said cylindrical support means, said support means including a movable cover means for covering said match striking means, and said movable cover means being movable to a position for exposing said match striking means.

10. A combination as in claim 9, wherein said movable cover means is comprised of a perforated portion in said cylindrical support means.

11. A combination as in claim 9, wherein said match means is adhesively attached to said cylindrical support means.

* * * * *